US010944204B2

(12) United States Patent
Nakai

(10) Patent No.: US 10,944,204 B2
(45) Date of Patent: Mar. 9, 2021

(54) CONNECTOR WITH A SEALING SURFACE, A MOVABLE PROTECTING MEMBER ON THE SEALING SURFACE AND A PUSH-IN PORTION IN A MATING CONNECTOR TO PUSH THE PROTECTING MEMBER FROM THE SEALING SURFACE

(71) Applicant: Sumitomo Wiring Systems, Ltd., Mie (JP)

(72) Inventor: Kazuo Nakai, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/812,707

(22) Filed: Mar. 9, 2020

(65) Prior Publication Data

US 2020/0295501 A1 Sep. 17, 2020

(30) Foreign Application Priority Data

Mar. 11, 2019 (JP) ..... JP2019-043472

(51) Int. Cl.

| | |
|---|---|
| ***H01R 13/52*** | (2006.01) |
| ***H01R 13/502*** | (2006.01) |
| ***H01R 13/506*** | (2006.01) |
| *H01R 13/453* | (2006.01) |
| *H01R 13/631* | (2006.01) |

(52) U.S. Cl.

CPC ..... *H01R 13/5202* (2013.01); *H01R 13/506* (2013.01); *H01R 13/5025* (2013.01); *H01R 13/4538* (2013.01); *H01R 13/5216* (2013.01); *H01R 13/5219* (2013.01); *H01R 13/631* (2013.01)

(58) Field of Classification Search

CPC ..... H01R 13/4538; H01R 13/5219; H01R 13/631

See application file for complete search history.

(56) References Cited

U.S. PATENT DOCUMENTS

| | | | | |
|---|---|---|---|---|
| 4,797,116 A * | 1/1989 | Isohata | ..... | H01R 13/506 439/141 |
| 4,832,613 A * | 5/1989 | Tsukakoshi | ..... | H01R 13/631 439/141 |
| 5,718,596 A | 2/1998 | Inaba et al. | | |
| 2003/0045150 A1 * | 3/2003 | Krause | ..... | H01R 13/4538 439/271 |

FOREIGN PATENT DOCUMENTS

| | | |
|---|---|---|
| JP | 2007-012592 | 1/2007 |
| JP | 2015-185282 | 10/2015 |

* cited by examiner

*Primary Examiner* — Tho D Ta

(74) *Attorney, Agent, or Firm* — Gerald E. Hespos; Michael J. Porco; Matthew T. Hespos

(57) ABSTRACT

It is aimed to provide a connector capable of ensuring good sealing. A connector (10) includes a female housing (20) having a female-side sealing surface (22), a male housing (30) having a receptacle (62) into which the female housing (20) is fit, a sealing ring (40) disposed in the receptacle (62) and to be held in close contact with the sealing surface (40) when the female housing (20) and the male housing (30) are connected, and a protecting member (50) mounted on the female housing (20) to cover the female-side sealing surface (22).

9 Claims, 18 Drawing Sheets

CONNECTOR WITH A SEALING SURFACE, A MOVABLE PROTECTING MEMBER ON THE SEALING SURFACE AND A PUSH-IN PORTION IN A MATING CONNECTOR TO PUSH THE PROTECTING MEMBER FROM THE SEALING SURFACE

BACKGROUND

Field of the Invention

The disclosure relates to a connector.

Related Art

Japanese Unexamined Patent Publication No. 2015-185282 discloses a connector with a male housing having a first tubular body and a female housing to be inserted into the first tubular body. A sealing member is mounted on an inner bottom surface of the tubular body. A waterproof structure is formed by sandwiching the sealing member by a sealing surface of the female housing and the inner bottom surface of the first tubular body. Further, the female housing includes a second tubular body surrounding the outer periphery of an inserting portion. Other female connector housings that have a sealing surface are disclosed Japanese Unexamined Patent Publication No. 2015-185282 and Japanese Unexamined Patent Publication No. 2007-12592.

The sealing surface of the female housing disclosed in Japanese Unexamined Patent Publication No. 2015-185282 is exposed to a large space before the male housing and the female housing are connected. Thus, the sealing surface of the female housing may interfere with external matter and may be damaged sufficiently to impair sealing ability.

Accordingly, it is aimed to provide a connector capable of ensuring good sealing.

SUMMARY

This disclosure is directed to a connector with a first housing having a sealing surface and a second housing including a receptacle into which the first housing can be fit. A sealing ring is disposed in the receptacle and is held in close contact with the sealing surface when the first housing and the second housing are connected. A protecting member is mounted on the first housing and covers the sealing surface. The protecting member prevents interference with external matter before the first and second housings are connected. As a result, damage of the sealing surface can be prevented and good sealing can be ensured.

The protecting member may be movable between a protecting position for covering the sealing surface and a retracted position retracted from the sealing surface. The second housing may include a push-in portion for pushing the protecting member from the protecting position to the retracted position in the process of connecting the first housing and the second housing. Thus, the protecting member need not be moved separately to the retracted position and work efficiency can be improved.

The push-in portion may be arranged inside the receptacle. Since the protecting member is pushed to the retracted position after the first housing is inserted into the receptacle, reliability in protecting the sealing surface can be enhanced.

The second housing may include a retainer inside the receptacle to prevent escape of the sealing ring. The push-in portion may be provided in the retainer. The retainer has a function of pushing the protecting member to the retracted position in addition to a function of restricting the escape of the sealing ring. Therefore, it is not necessary to provide a special structure for pushing the protecting member to the retracted position and the structure can be simplified.

The first housing may include a lock and a stopper. Additionally, the second housing may include a housing side lock arm for restricting separation from the first housing by contact with the lock. The protecting member may include a protecting member side lock arm for restricting a movement from the protecting position to the retracted position by contact with the stopper. A coupling may link an operation of the housing side lock arm to ride over the lock and to resiliently return and an operation of the protecting member side lock arm to ride over the stopper and resiliently return.

A stop contact state of the protecting member side lock arm and the stopper can be released automatically via the coupling when the first and second housings are connected. Thus, a special operation of releasing the contact stop state of the protecting member side lock arm and the stopper is unnecessary and work efficiency can be improved. Further, the protecting member side lock arm resiliently returns after the first and second housings are connected to ensure that no residual stress remains in the protecting member side lock arm.

The coupling may enable convex-concave fitting of the housing side lock arm and the protecting member side lock arm in a connecting direction of the first housing and the second housing and may restrict displacements of the housing side lock arm and the protecting member side lock arm in directions separating from each other. Thus, even if the coupling has a simple structure, a coupled state of the housing side lock arm and the protecting member side lock arm can be maintained.

The protecting member side lock arm may include an operating portion on an end part. The operating portion may release a contact stop state of the housing side lock arm and the lock portion by being pressed, and the operating portion may be arranged to project from an opening of the receptacle when the first housing and the second housing are connected. The coupling couples the protecting member side lock arm and the housing side lock arm. Additionally, the operating portion is provided on the protecting member side lock arm and projects from the opening of the receptacle. Thus, the contact stop state of the housing side lock arm and the lock portion can be released without any trouble.

According to the present disclosure, it is possible to provide a connector capable of ensuring sealability.

DETAILED DESCRIPTION

A specific example of the connector of the present disclosure is described below with reference to the drawings. Note that the present invention is not limited to these illustrations and is intended to be represented by claims and include all changes in the scope of claims and in the meaning and scope of equivalents.

Figure 6:
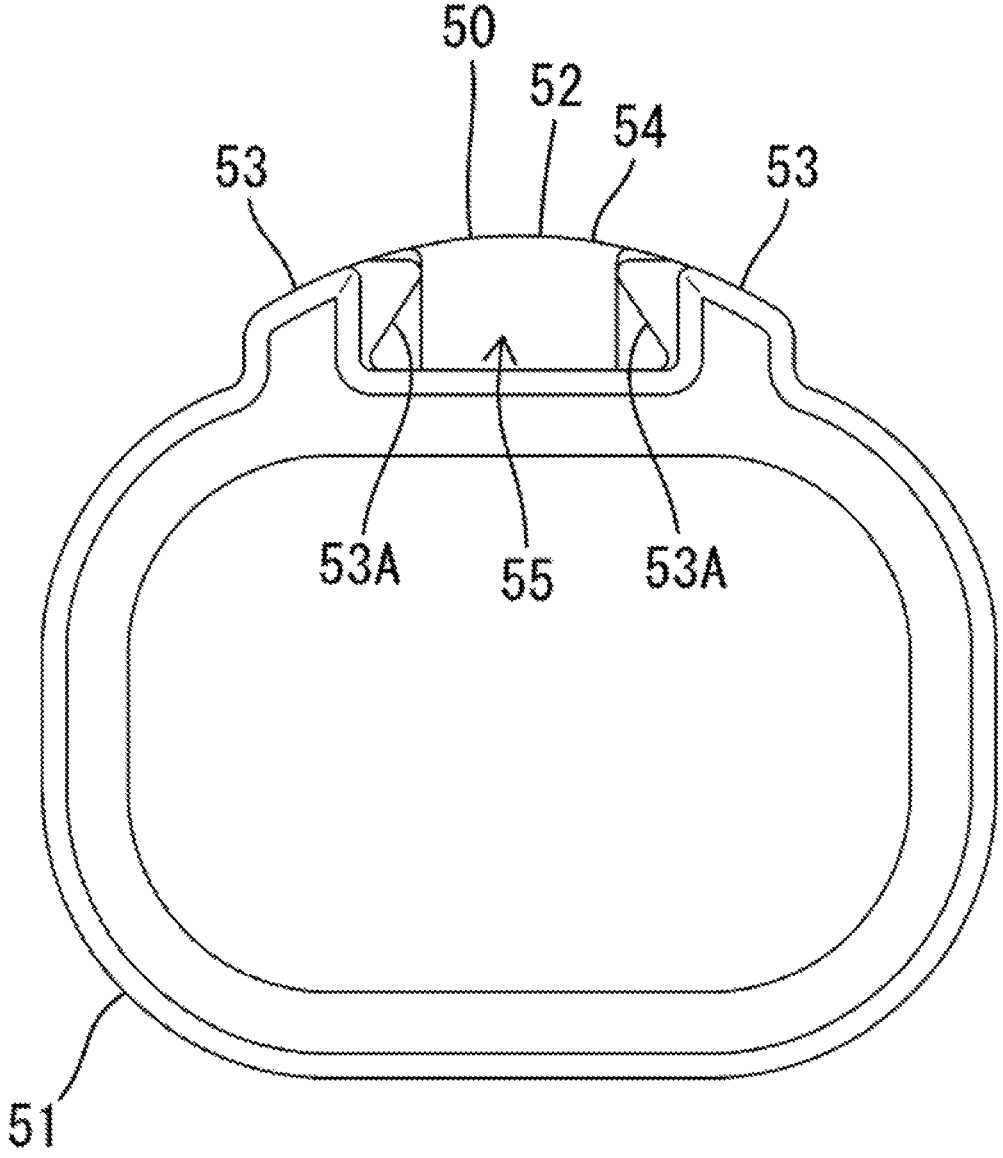
FIG. 6 is a front view of the protecting member.
Figure 7:
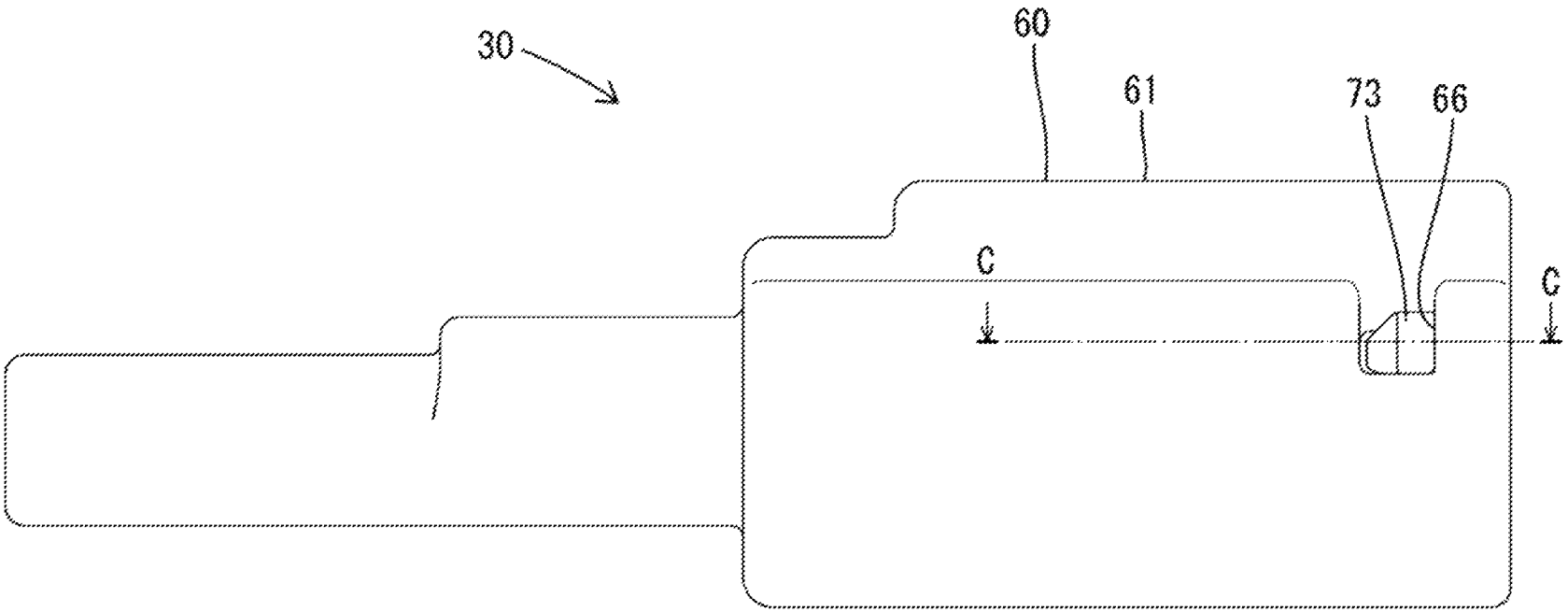
FIG. 7 is a side view of a male housing.

One embodiment of the invention is described with reference to FIGS. 1 to 22. Note that, in the following description of each housing, a side facing a mating housing to be connected is referred to as a front end concerning a front-rear direction. For example, a left side of FIG. 4 and a right side of FIG. 7 are referred to as front ends. Further, upper and lower sides are based on a vertical direction of FIG. 15.

Figure 1:
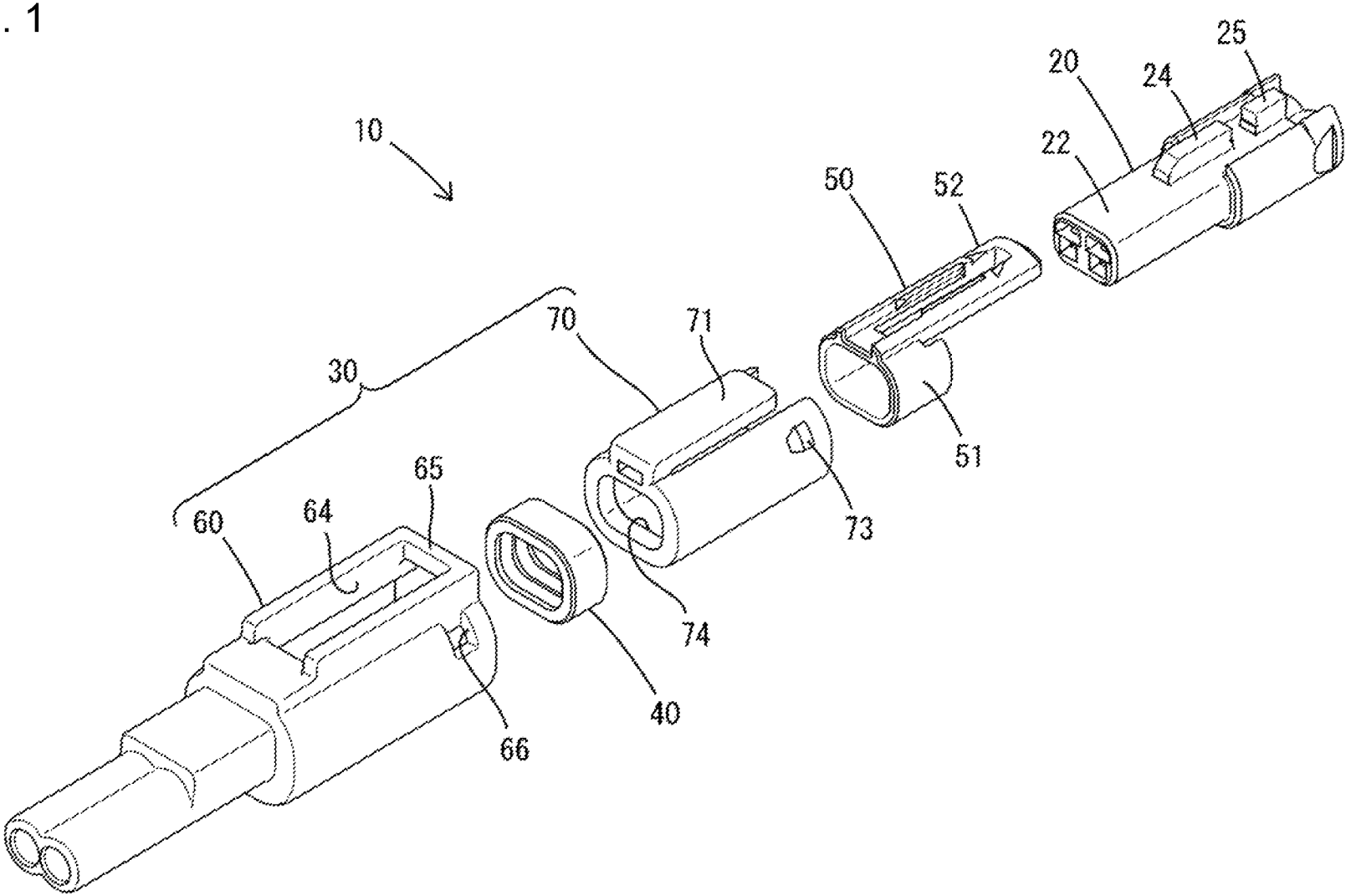
FIG. 1 is an exploded perspective view of a connector according to one embodiment.

As shown in FIG. 1, a connector 10 includes a female housing 20 (first housing), a male housing 30 (second housing), a sealing ring 40 and a protecting member 50. Note that although terminal fittings are accommodated in each of the female housing 20 and the male housing 30 in the connector 10, the terminal fittings are not mentioned in the following description.

Figure 2:
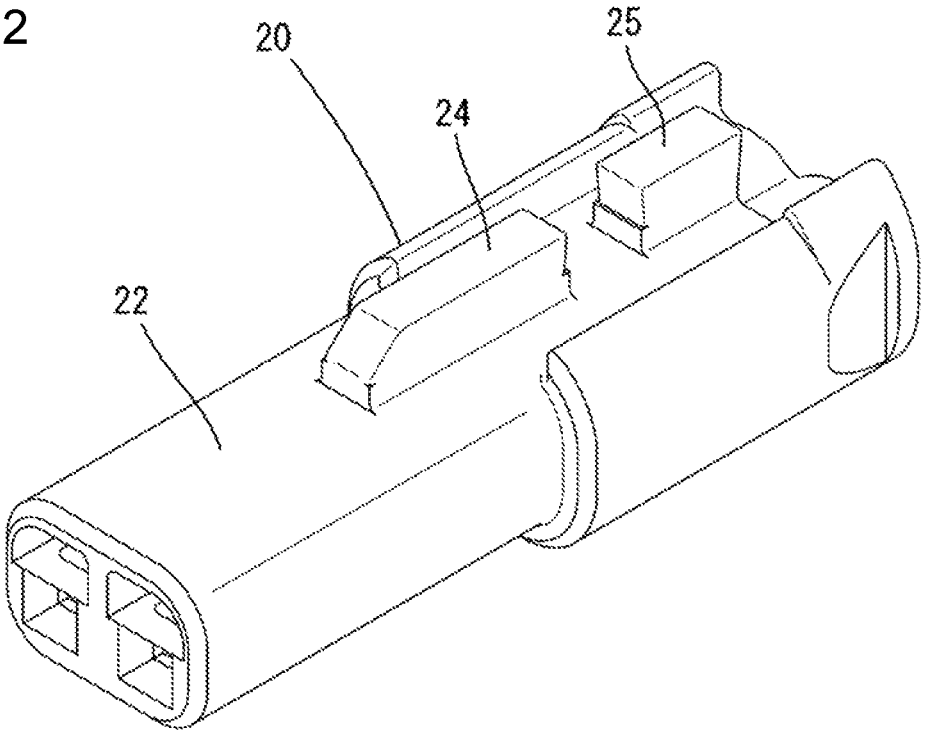
FIG. 2 is a perspective view of a female housing.
Figure 3:
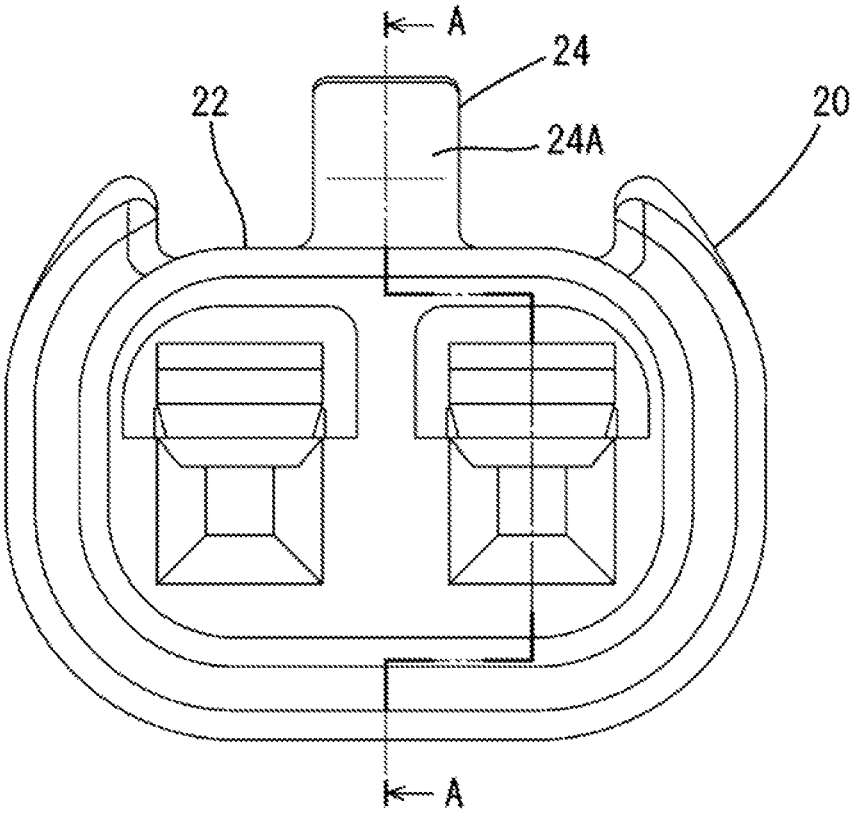
FIG. 3 is a front view of the female housing.
Figure 4:
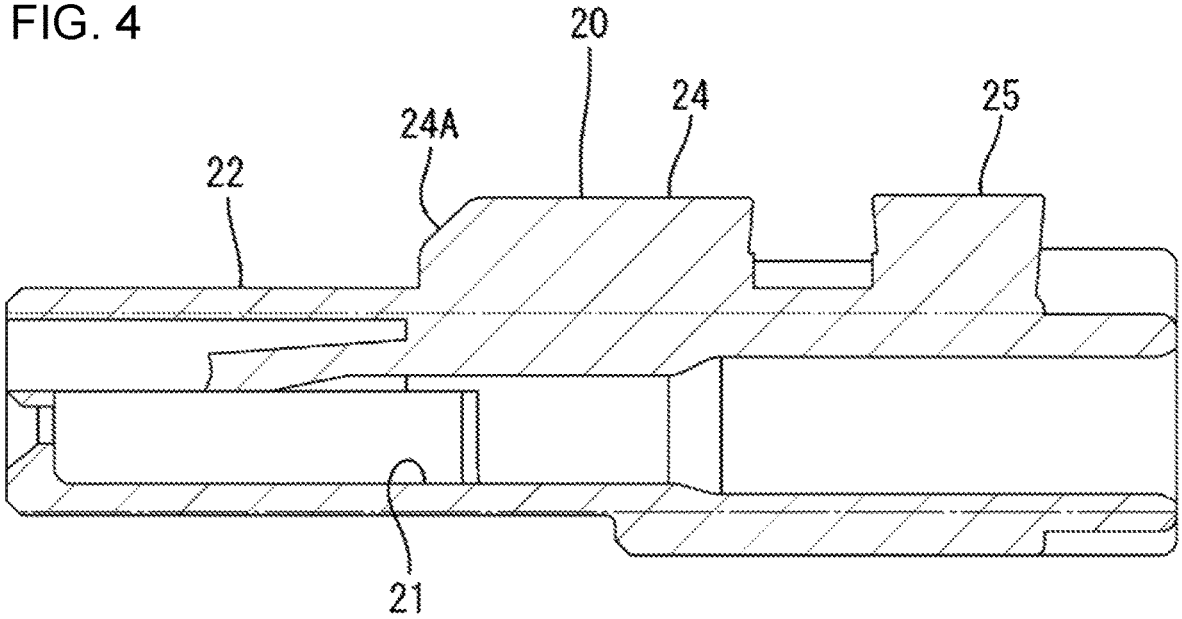
FIG. 4 is a section along A-A of FIG. 3.

The female housing 20 is made of synthetic resin. As shown in FIG. 4, the female housing 20 includes cavities 21 into which the terminal fittings are insertable. The cavities 21 penetrate through the female housing 20 in the front-rear direction. As shown in FIGS. 2 to 4, a female-side sealing surface 22 (sealing surface) is formed on the outer peripheral surface of a front end of the female housing 20. The female-side sealing surface 22 is to be held in close contact with a male-side sealing surface 63 of the male housing 30 to be described later via the sealing ring 40 after the housings are connected.

A lock 24 and a stopper 25 are formed on an upper side of the female housing 20. The lock 24 projects upward in a central part of the female housing 20 in the front-rear direction and has a rectangular parallelepiped shape long in the front-rear direction. A taper 24A inclined toward the rear is formed on a front part of the lock 24. An upper end side of the rear end surface of the lock 24 is inclined in an overhanging manner. The stopper 25 projects up behind the lock 24 on the female housing 20 and has a rectangular parallelepiped shape long in the front-rear direction. An upper end side of the front surface of the stopper 25 is inclined in an overhanging manner.

Figure 5:
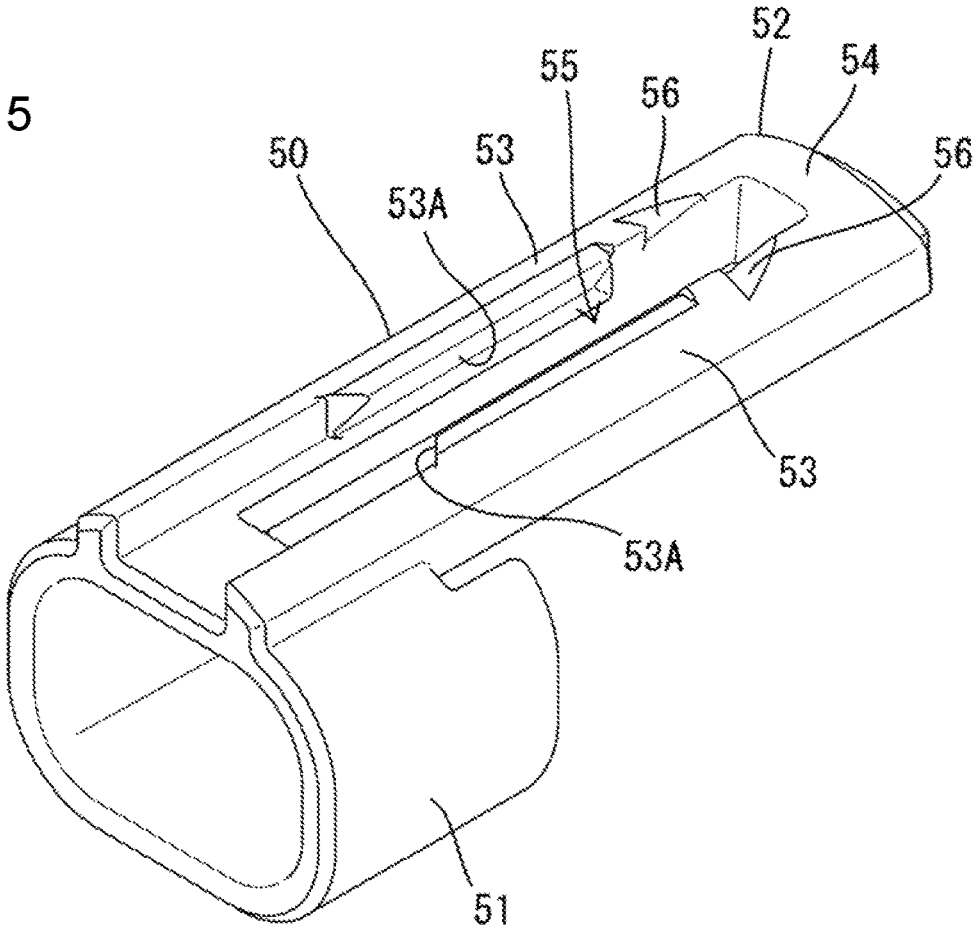
FIG. 5 is a perspective view of a protecting member.

The protecting member 50 is a member for covering the female-side sealing surface 22 when the female housing 20 is in a single state before connection. The protecting member 50 is made of synthetic resin and is mounted on the female housing 20. As shown in FIGS. 5 and 6, the protecting member 50 is formed with a tubular portion 51. The tubular portion 51 has a smooth inner peripheral surface arrangeable along the female-side sealing surface 22 to correspond to the female-side sealing surface 22 of the female housing 20. The protecting member 50 is formed with a protecting member side lock arm 52 that projects rearward from the tubular portion 51. The protecting member side lock arm 52 includes two arms 53 and an operating portion 54. The arms 53 are provided in parallel to extend along the front-rear direction. Each of the arms 53 includes an inclined portion 53A. The inclined portions 53A face each other and are inclined upward on inner surfaces of intermediate parts of the arms 53 in the front-rear direction. Two of the inclined portions 53A define both sides of a recess 55 in the form of a dovetail groove. The arms 53 include grooves 56 respectively behind the both inclined portions 53A. The bottom surfaces of the grooves 56 are inclined upward.

As shown in FIGS. 5 and 6, the operating portion 54 is formed to couple rear end parts of the two arms 53. The operating portion 54 functions to release a contact stop state of a housing side lock arm 71 to be described later and the lock 24 by being pressed when the female housing 20 and the male housing 30 are connected.

Figure 13:
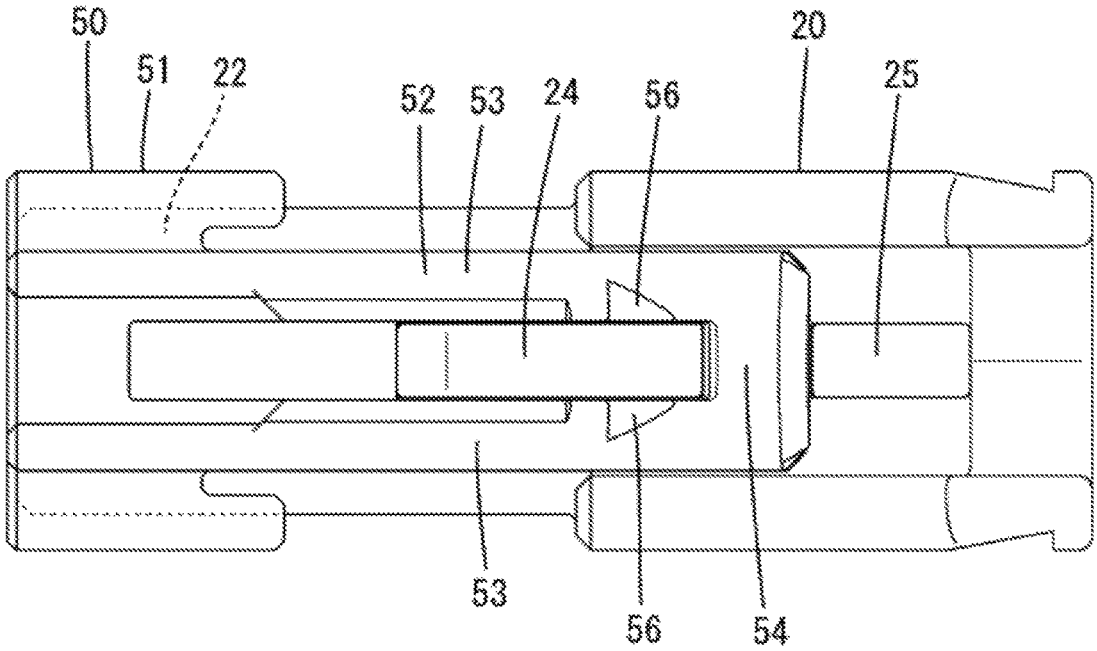
FIG. 13 is a plan view showing a state where the protecting member is at a protecting position with respect to the female housing.
Figure 14:
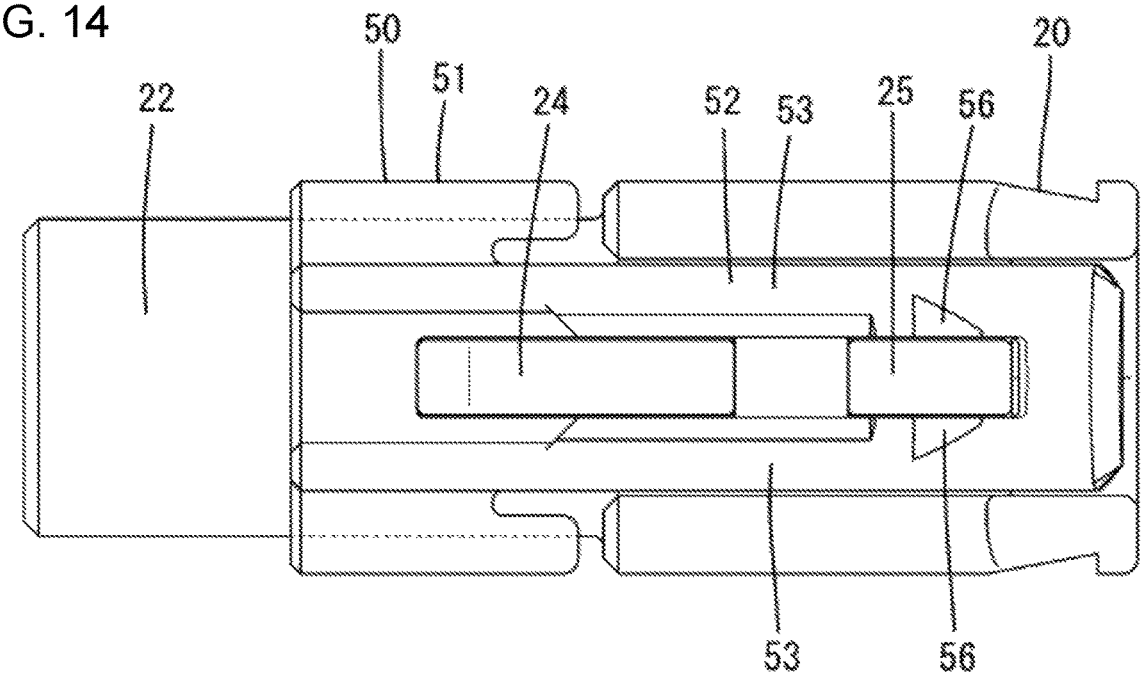
FIG. 14 is a plan view showing a state where the protecting member is at a retracted position with respect to the female housing.

The protecting member 50 is movable with respect to the female housing 20 between a protecting position (see FIG. 13) for covering the female-side sealing surface 22 and a retracted position (see FIG. 14) retracted from the female-side sealing surface 22. Specifically, when the protecting member 50 is at the protecting position, the tubular portion 51 covers the female-side sealing surface 22 as shown in FIG. 13. A distance between the tubular portion 51 and the female-side sealing surface 22 is smaller than a thickness of the sealing ring 40 to be described later, so that the tubular portion 51 and the female-side sealing surface 22 are in contact with or proximate to each other. When the protecting member 50 is at the protecting position, the lock 24 is located between the arms 53. The operating portion 54 is located between the lock 24 and the stopper 25. On the other hand, when the protecting member 50 is at the retracted position, the tubular portion 51 is retracted rearwardly of the female-side sealing surface 22 as shown in FIG. 14. The lock 24 and the stopper 25 are located between the two arms 53. The operating portion 54 is located behind the stopper 25.

Figure 8:
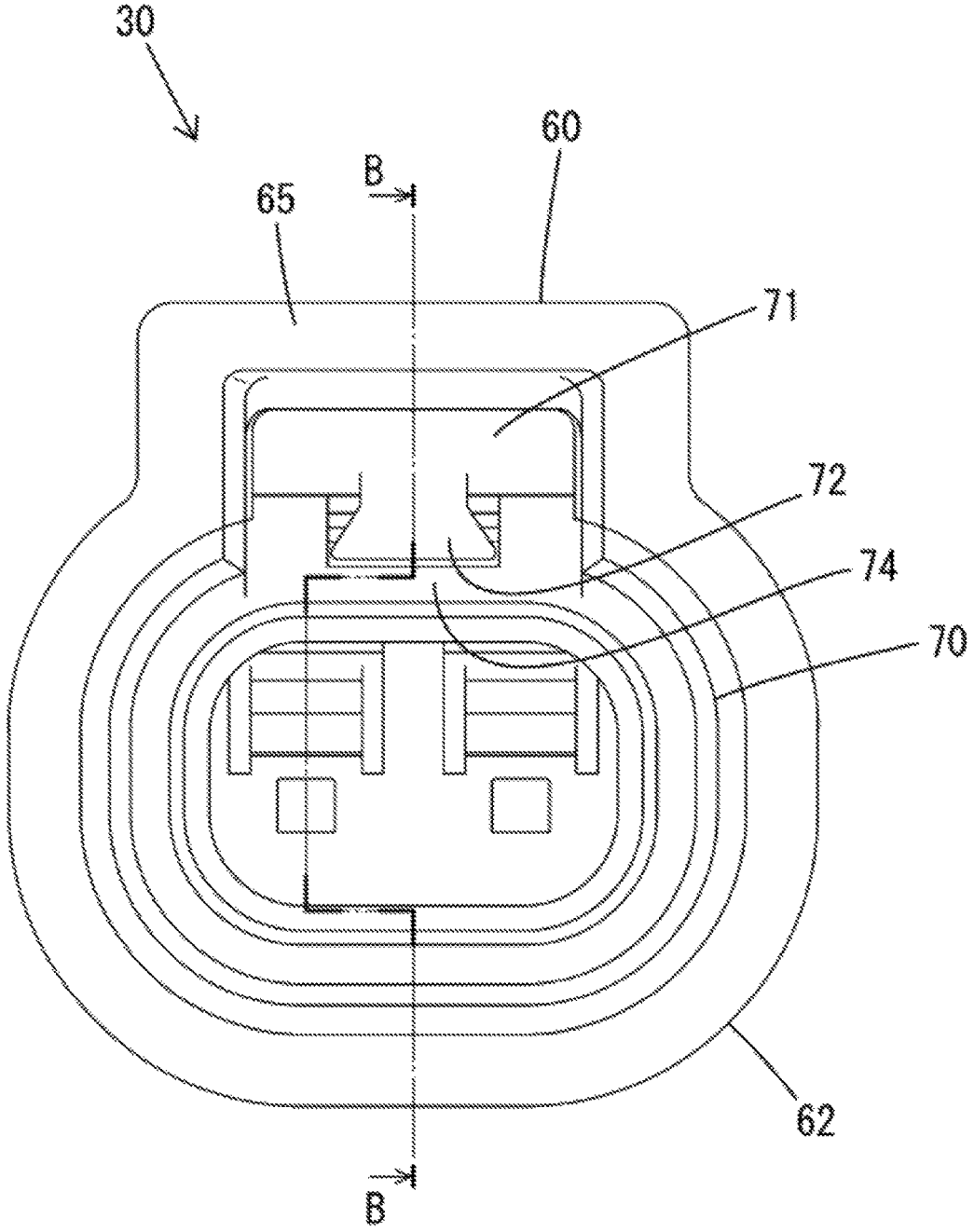
FIG. 8 is a front view of the male housing.
Figure 9:
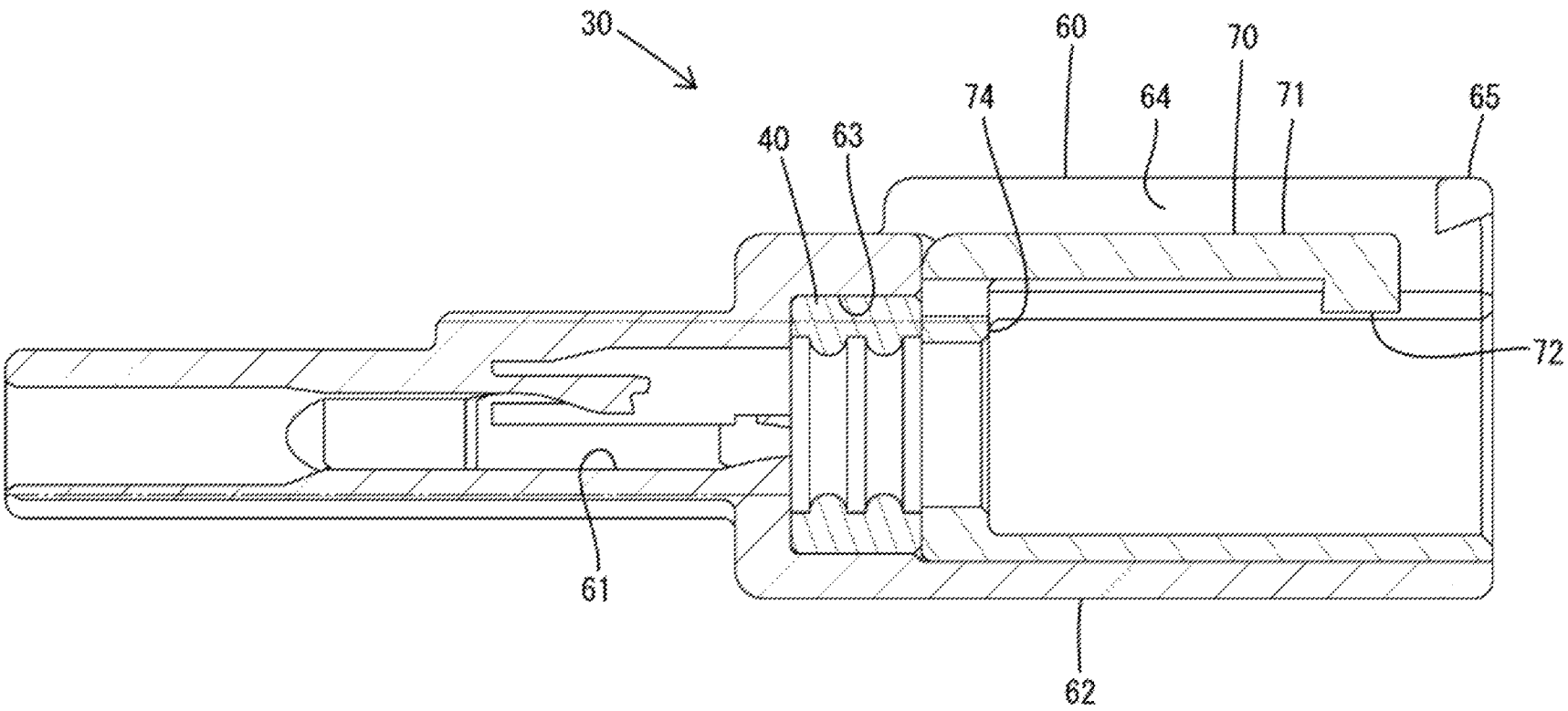
FIG. 9 is a section along B-B of FIG. 8.
Figure 10:
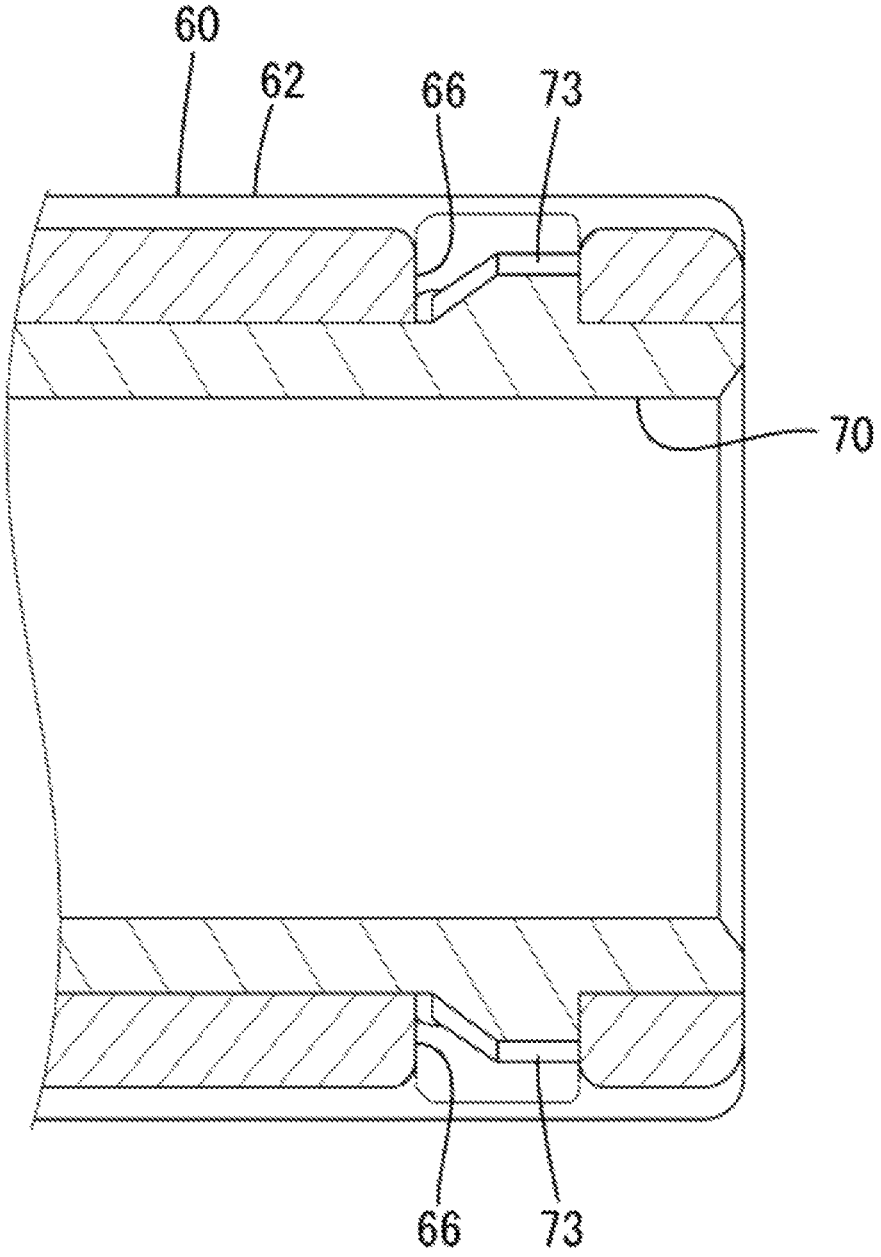
FIG. 10 is a section along C-C of FIG. 7.
Figure 11:
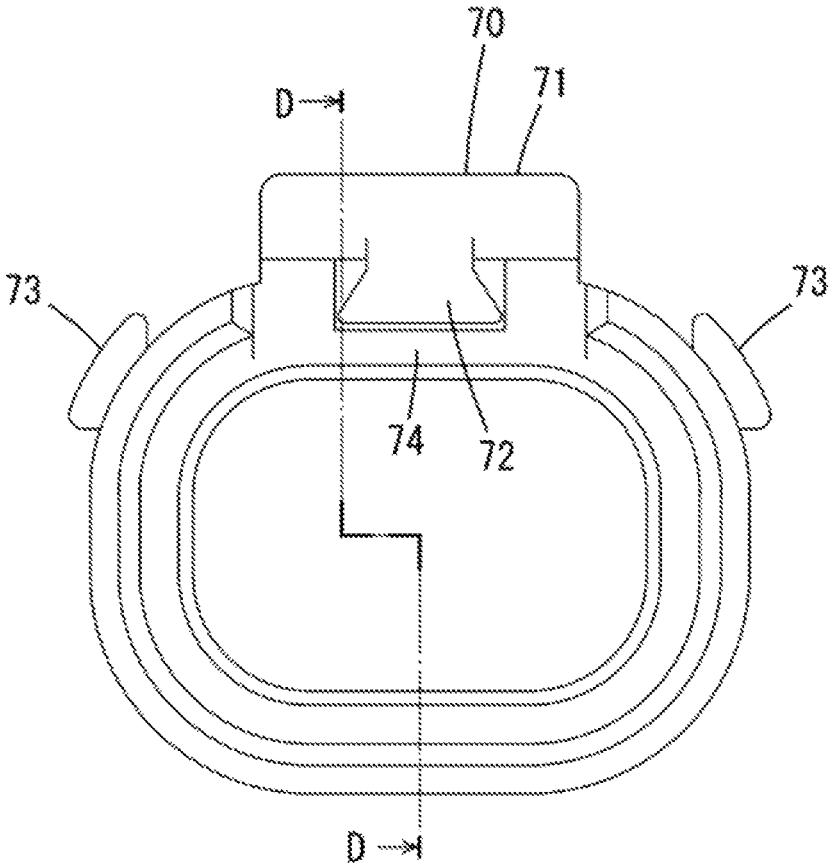
FIG. 11 is a front view of a retainer.

As shown in FIGS. 7 to 9, the female housing 30 includes a body 60 and a retainer 70. The body 60 is made of synthetic resin and has two cavities 61 into which terminal fittings are insertable. The cavities 61 penetrate through a rear end side of the body 60 in the front-rear direction. A tubular receptacle 62 is formed on a front end of the body 60. The female housing 20 is fit into the receptacle 62 from the right side of FIG. 9. The male-side sealing surface 63 is formed on the inner peripheral surface of a rear end side of the receptacle 62. As shown in FIG. 1, a rectangular opening 64 is formed in an upper side of the receptacle 62 and a beam 65 is formed on the front end of the opening 64. The beam 65 has, on a lower surface, a part projecting rearward and downward. A through hole 66 is formed in each of both side walls of the receptacle 62.

The sealing ring 40 is made of rubber, such as silicon rubber. The sealing ring 40 is shaped to correspond to the shapes of the female-side sealing surface 22 and the male-side sealing surface 63. As shown in FIG. 9, the sealing ring 40 is disposed on a rear end in the receptacle 62. The sealing ring 40 is held in close contact with the female-side sealing surface 22 and the male-side sealing surface 63 when the female housing 20 and the male housing 30 are connected.

Figure 12:
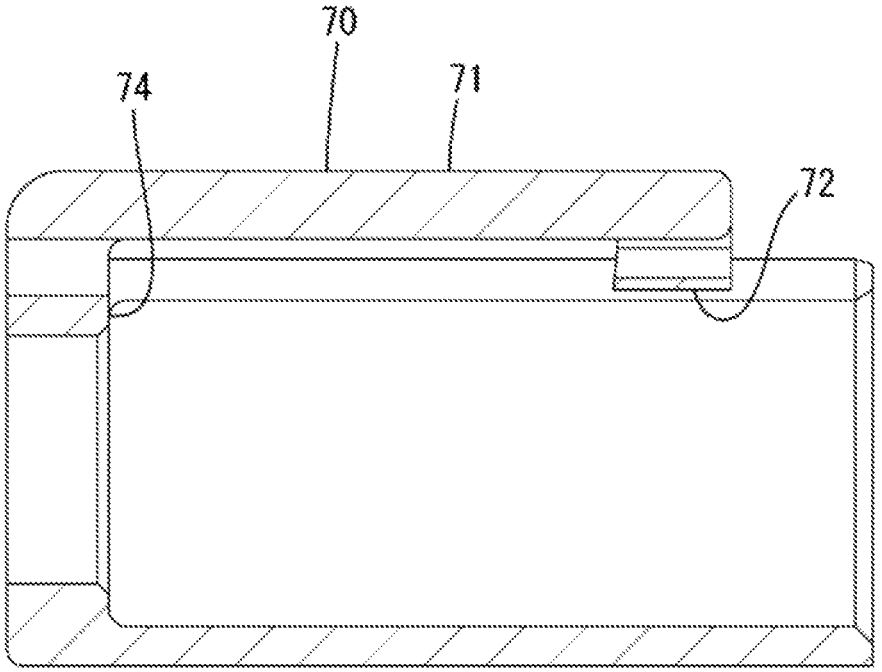
FIG. 12 is a section along D-D of FIG. 11.

As shown in FIG. 9, the retainer 70 is disposed on a rear end inside the receptacle 62. The retainer 70 is in contact with the sealing ring 40 from the front and restricts the escape of the sealing ring 40. As shown in FIG. 12, the retainer 70 has a smooth hollow cylindrical shape and is formed with the housing side lock arm 71 on a part of the upper wall of the retainer 70. The housing side lock arm 71 projects forward from the rear end of the retainer 70. A protrusion 72 projects down from the tip of the housing side lock arm 71. The protrusion 72 has a dovetail-shaped cross-section widened toward a lower side. A dimension of the protrusion 72 is substantially equal to that of the operating portion 54 in the front-rear direction. The dimension of the protrusion 72 in the front-rear direction is little smaller than the distance between the lock 24 and the stopper 25.

A projection 73 projecting outward is formed on each of upper end sides of both side walls of the retainer 70. With the retainer 70 disposed inside the receptacle 62, a pair of the projections 73 are inserted respectively in the through holes 66. In this way, the retainer 70 is held in the receptacle 62. The protrusion 72 is located behind the beam 65.

As shown in FIG. 12, a push-in portion 74 is formed on the rear end of the retainer 70. The push-in portion 74 is provided circumferentially on the rear end of the retainer 70. The push-in portion 74 functions to push the protecting member 50 from the protecting position to the retracted position in the process of connecting the female housing 20 and the male housing 30. The push-in portion 74 is disposed inside the receptacle 62.

As described later, a coupling 80 (see FIG. 16) is constituted by the recess 55 of the protecting member 50 and the protrusion 72 of the retainer 70. The coupling 80 realizes convex-concave fitting of the housing side lock arm 71 and the protecting member side lock arm 52 in a connecting direction of the female housing 20 and the male housing 30 (front-rear direction) and restricts displacements of the housing side lock arm 71 and the protecting member side lock arm 52 in directions separating from each other.

Next, functions of this embodiment are described.

Figure 15:
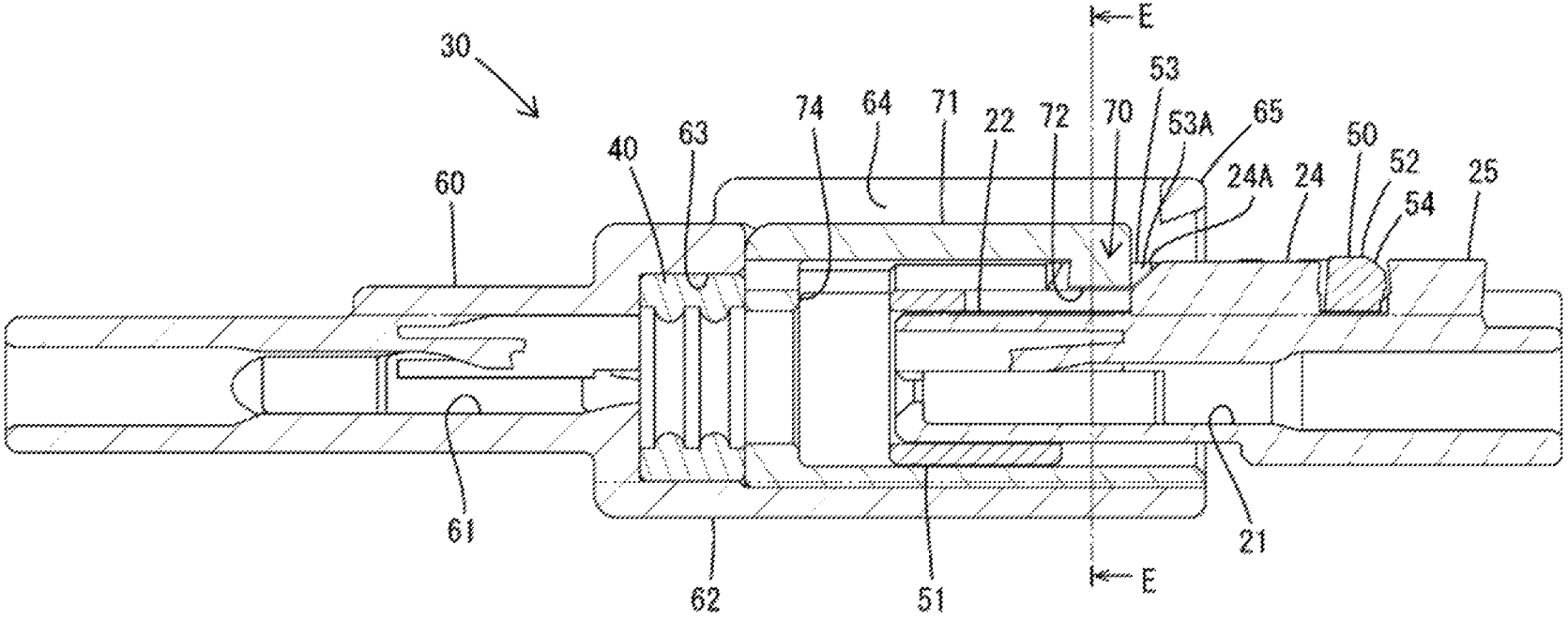
FIG. 15 is a side view in section showing a state when the connection of the female housing to the male housing is started.
Figure 16:
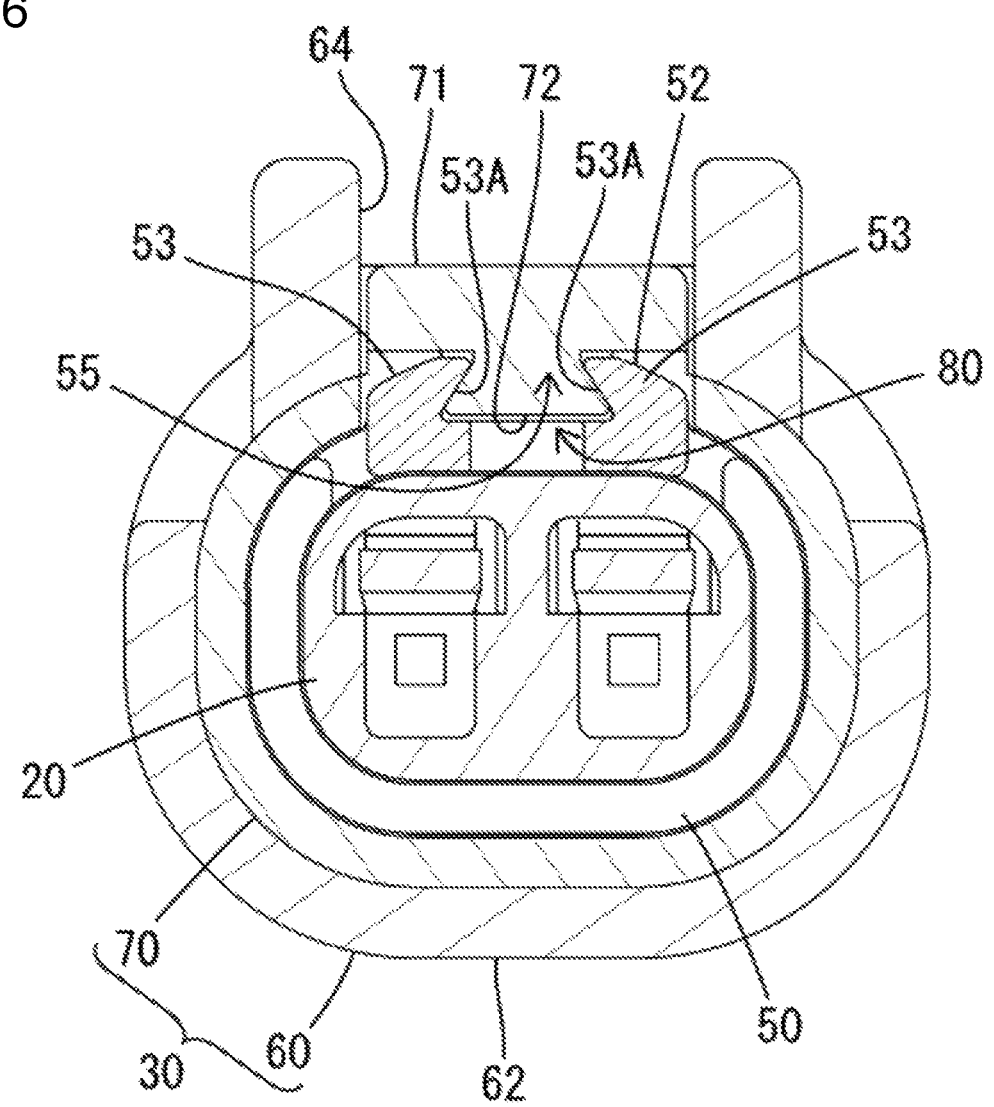
FIG. 16 is a section along E-E of FIG. 15.

The female housing 20 and the male housing 30 are connected by inserting a tip of the female housing 20 into the receptacle 62, as shown in FIG. 15. The tip of the protecting member side lock arm 52 contacts the stopper 25 to restrict a movement of the protecting member 50 from the protecting position to the retracted position. When the protrusion 72 of the housing side lock arm 71 enters the recess 55 of the protecting member side lock arm 52, as shown in FIG. 16, the housing side lock arm 71 and the protecting member side lock arm 52 fit convexly and concavely in the connecting direction. The housing side lock arm 71 and the protecting member side lock arm 52 can integrally behave (be resiliently deformed) by the coupling 80.

Figure 17:
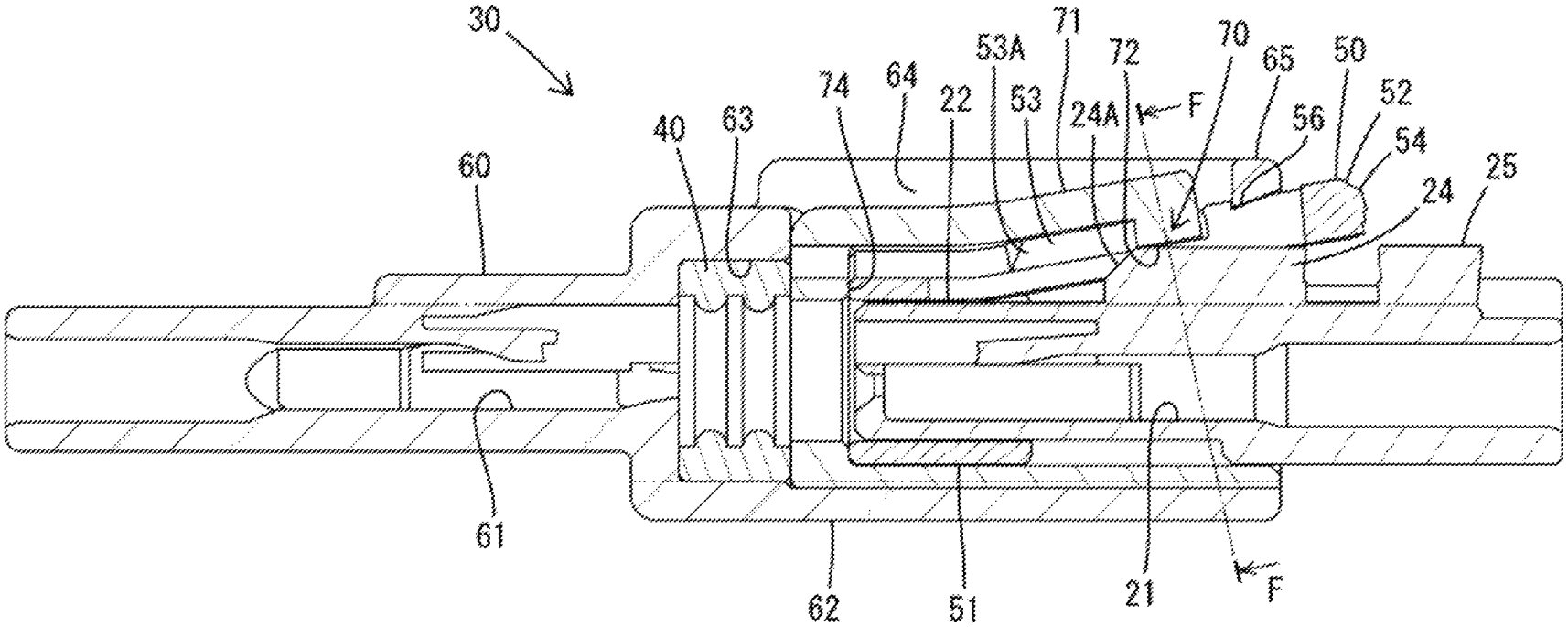
FIG. 17 is a side view in section showing a state while the female housing is being inserted into the male housing.
Figure 18:
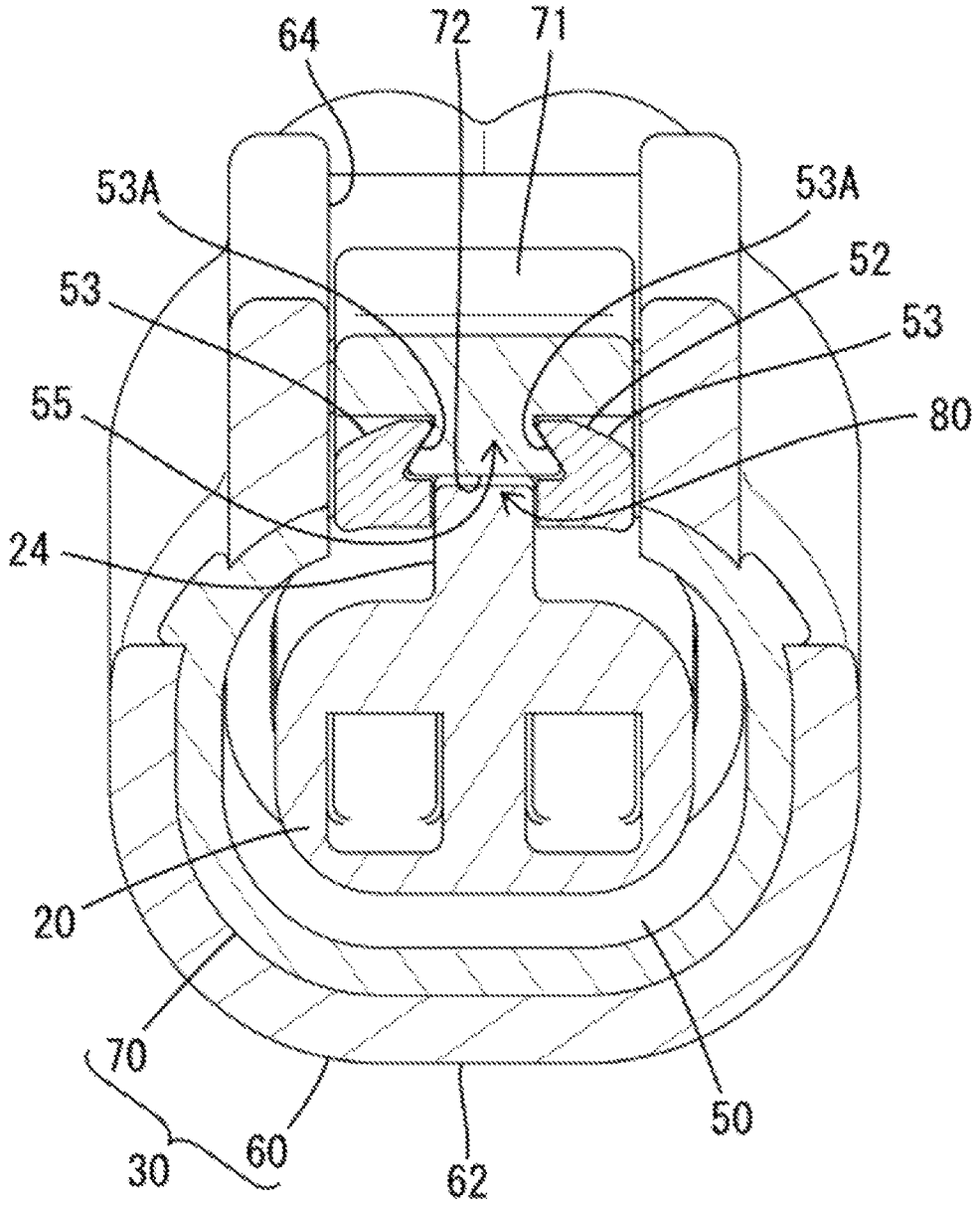
FIG. 18 is a section along F-F of FIG. 17.

When the female housing 20 is inserted farther toward the back of the receptacle 62, as shown in FIGS. 17 and 18, the housing side lock arm 71 rides on the lock 24. In association with this, the protecting member side lock arm 52 is deflected and deformed upwardly. The beam 65 enters the groove 56 to restrict a movement of the protecting member 50 in a direction away from the male housing 30. Thus, a relative positional relationship of the housing side lock arm 71 and the protecting member side lock arm 52 is maintained.

Figure 19:
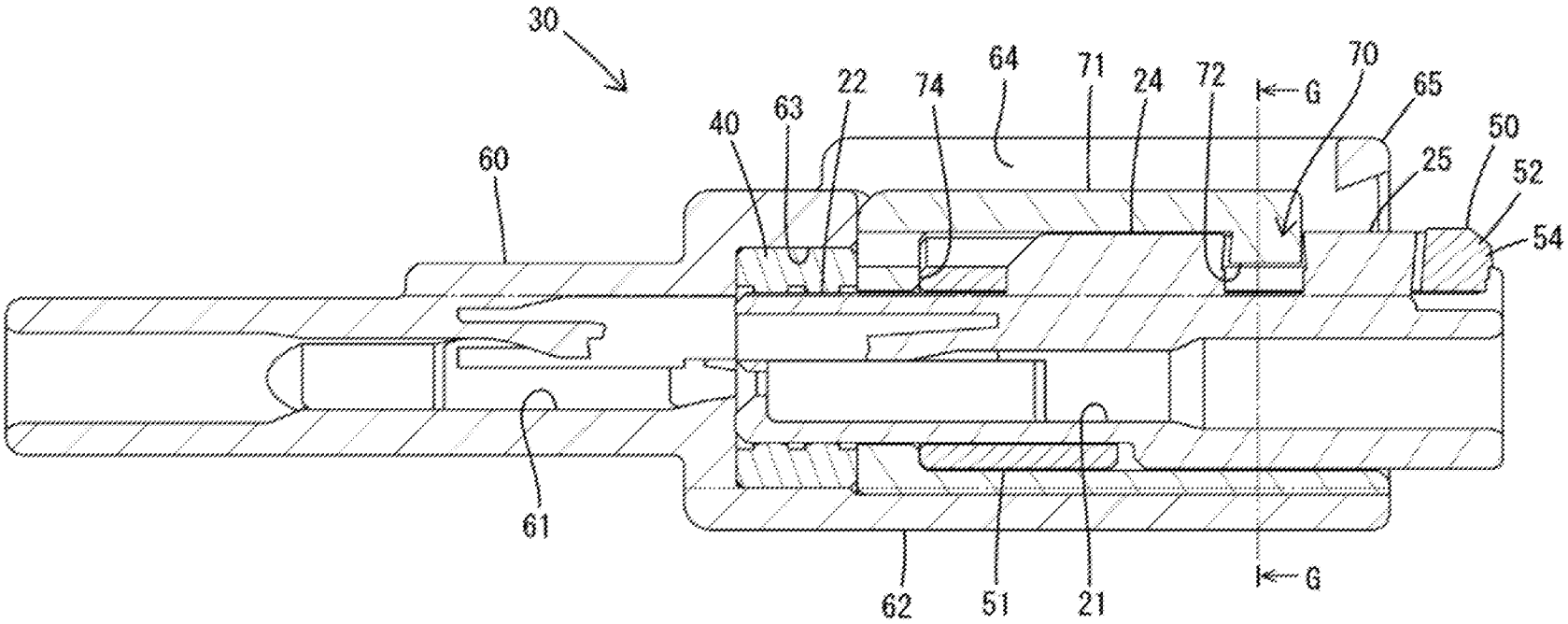
FIG. 19 is a side view in section showing a state when the connection of the female housing to the male housing is completed.
Figure 20:
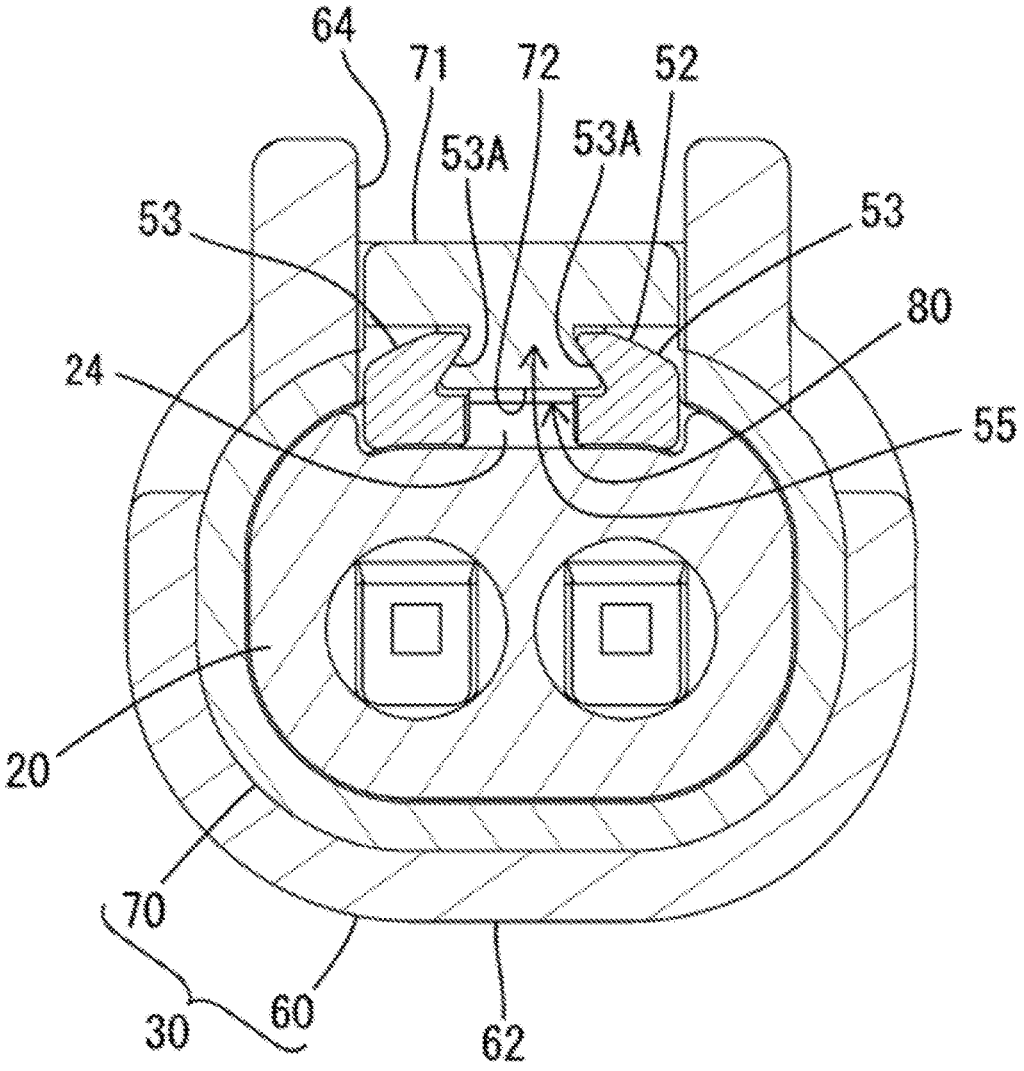
FIG. 20 is a section along G-G of FIG. 19.

When the female housing 20 is further inserted toward the back of the receptacle 62 as shown in FIGS. 19 and 20, the push-in portion 74 of the retainer 70 pushes the tip of the protecting member 50 and the female-side sealing surface 22 is inserted into a space inside the push-in portion 74. Then, the housing side lock arm 71 rides over the lock 24 and resiliently returns (locking operation). The coupling 80 ensures that the protecting member side lock arm 52 rides over the stopper 25 and resiliently returns (retracting operation) along with the locking operation. Specifically, the protecting member 50 moves from the protecting position to the retracted position. As described above, the locking operation and the retracting operation are linked by the coupling portion 80.

When the locking operation is performed, the protrusion 72 of the housing side lock arm 71 enters between the lock 24 and the stopper 25, as shown in FIGS. 19 and 20. The separation of the housing side lock arm 71 from the female housing 20 is restricted by contact with the lock 24. When the retracting operation is performed, the operating portion 54 of the protecting member side lock arm 52 is located on the outer side of the stopper 25. The female-side sealing surface 22 of the female housing 20 passes through the push-in portion 74 of the retainer 70 and is held in close contact with the inside of the sealing ring 40. In this way, the connection of the female housing 20 and the male housing 30 is completed.

Figure 21:
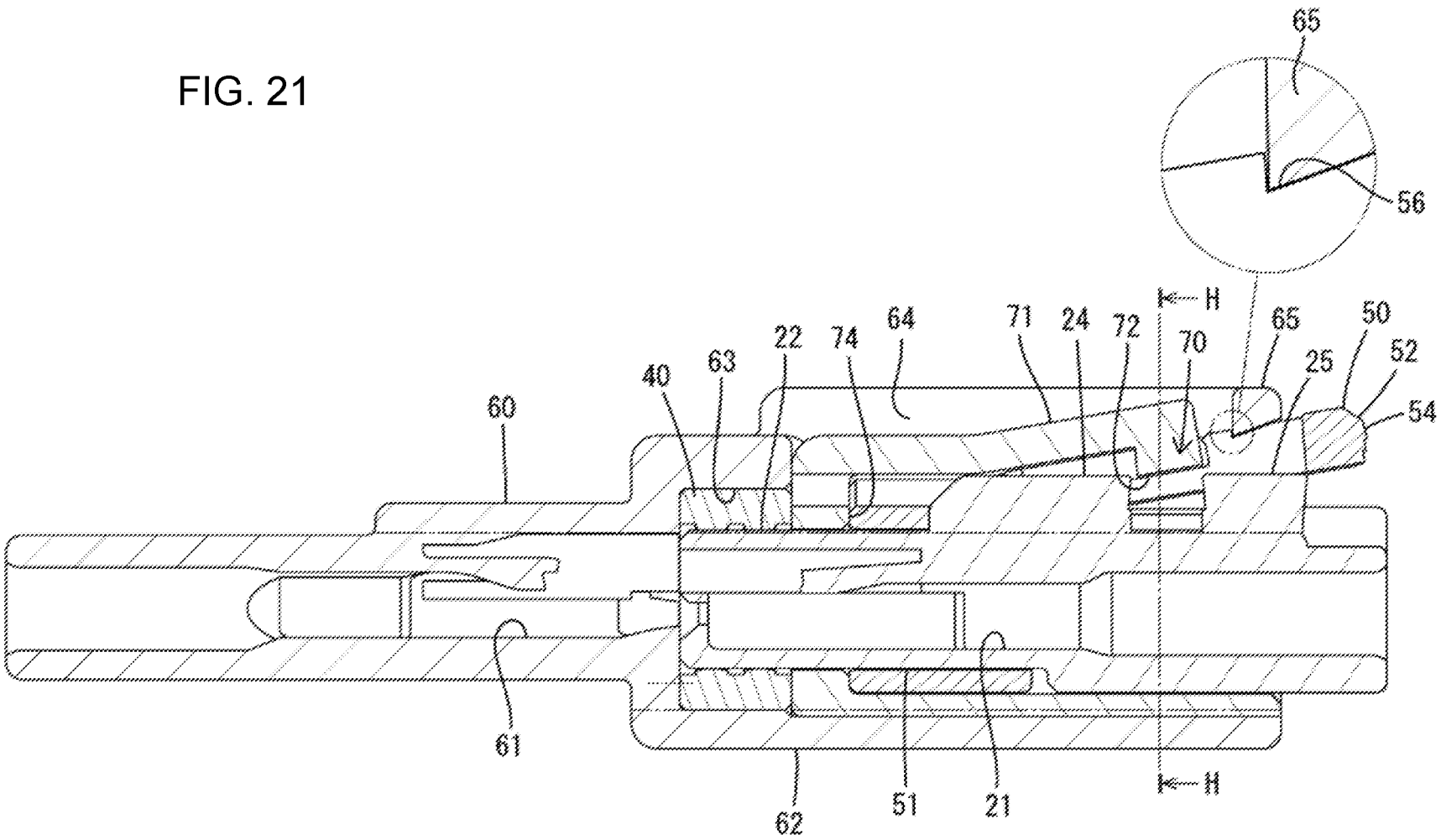
FIG. 21 is a side view in section showing a state at the time of releasing the connector.
Figure 22:
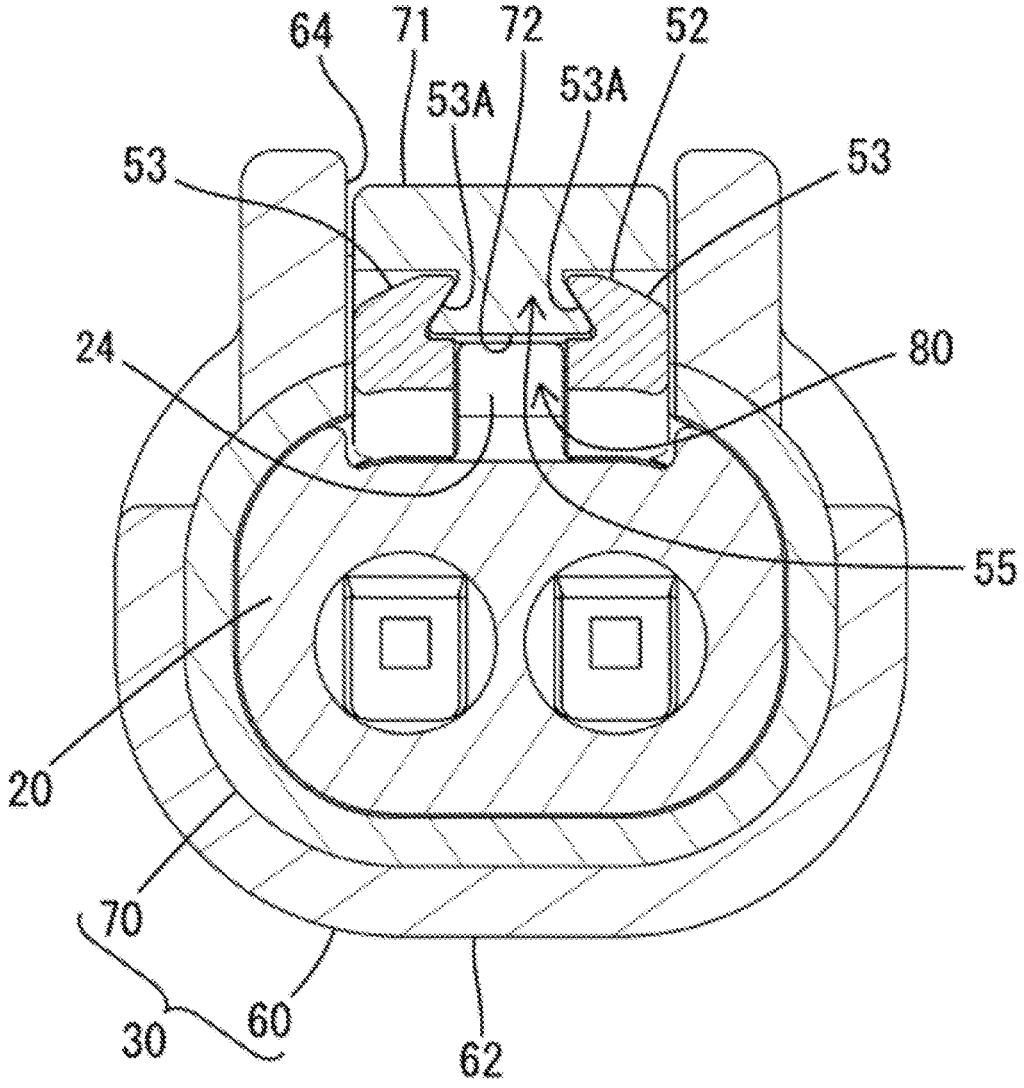
FIG. 22 is a section along H-H of FIG. 21.

When the female housing 20 and the male housing 30 are connected, the operating portion 54 projects from the opening 67 of the receptacle 62, as shown in FIG. 19. As shown in FIGS. 21 and 22, the operating portion 54 is pressed up. Then, the housing side lock arm 71 is deflected and deformed upwardly. The protrusion 72 comes out up from a clearance between the lock 24 and the stopper 25 and the contact stop state of the housing side lock arm 71 and the lock portion 24 is released. The beam 65 enters the groove 56 at this time to restrict a movement of the protecting member 50 with respect to the male housing 30. In this state, the female housing 20 is moved in a direction separating from the male housing 30, and is separated from the male housing 30, and the protecting member 50 returns to the protecting position.

As described above, since the female-side sealing surface 22 is covered by the protecting member 50 before the connection of the female housing 20 and the male housing 30 in the connector 10, interference with external matter is prevented. As a result, the damage of the female-side sealing surface 22 can be prevented and sealing can be ensured. The female-side sealing surface 22 needs not be surrounded and protected by a tubular body integrally provided to the female housing 20 as before. Thus, the female-side sealing surface 22 can be protected while the connector 10 is reduced in size.

The protecting member 50 is pushed from the protecting position to the retracted position by the push-in portion 74 in the process of connecting the female housing 20 and the male housing 30. Thus, the protecting member 50 need not be separately moved to the retracted position and workability can be improved.

Since the protecting member 50 is pushed to the retracted position after the female housing 20 is inserted into the receptacle 62 in the connector 10 of the present disclosure, reliability in protecting the female-side sealing surface 22 can be enhanced.

In the connector 10 of the present disclosure, the retainer 70 has a function of pushing the protecting member 50 to the retracted position in addition to a function of restricting the escape of the sealing ring 40. Thus, it is not necessary to provide a dedicated structure for pushing the protecting member 50 to the retracted position and an overall structure can be simplified.

In the connector 10 of the present disclosure, a contact stop state of the protecting member side lock arm 52 and the stopper 25 can be automatically released via the coupling 80 when the female housing 20 and the male housing 30 are connected. Thus, a special operation of releasing the contact stop state of the protecting member side lock arm 52 and the stopper 25 is unnecessary and workability can be improved. Further, the protecting member side lock arm 52 resiliently returns after the connection of the female housing 20 and the male housing 30 so that residual stress does not remain in the protecting member side lock arm 52.

In the connector 10 of the present disclosure, the coupling 80 has a simple structure and can satisfactorily maintain a coupled state of the housing side lock arm 71 and the protecting member side lock arm 52.

In the connector 10 of the present disclosure, the protecting member side lock arm 52 and the housing side lock arm 71 are coupled by the coupling 80 and the operating portion 54 is provided on the protecting member side lock arm 52 and projects from the opening of the receptacle 62. Thus, the operation of releasing the contact stop state of the housing side lock arm 71 and the lock 24 can be performed without any trouble.

The embodiment disclosed herein should be construed as illustrative rather than restrictive in all aspects.

For example, although the retainer 70 is provided with the push-in portion 74 in the above embodiment, the body 60 may be provided with a push-in portion as another embodiment.

Although the coupling 80 is composed of the recess 55 in the form of a dovetail groove and the protrusion 72 having a trapezoidal cross-section in the above embodiment, the recess 55 and the protrusion 72 may have other shapes if configured to realize convex-concave fitting in the connecting direction of the female housing 20 and the male housing 30. For example, the coupling 80 may have the convex-concave fitting of a recess 55 having an inverted T-shaped cross-section and a protrusion 72 having an inverted T-shaped cross-section and projecting down in the connecting direction of the female housing 20 and the male housing 30.

LIST OF REFERENCE SIGNS

10 . . . connector
20 . . . female housing (first housing)
21 . . . cavity
22 . . . female-side sealing surface (sealing surface)
24 . . . lock
24A . . . taper
25 . . . stopper
30 . . . male housing (second housing)
40 . . . sealing ring
50 . . . protecting member
51 . . . tubular portion
52 . . . protecting member side lock arm
53 . . . arm
53A . . . inclined portion
54 . . . operating portion
55 . . . recess
56 . . . groove
60 . . . body
61 . . . cavity
62 . . . receptacle
63 . . . male-side sealing surface
64 . . . opening
65 . . . beam
66 . . . through hole
67 . . . opening
70 . . . retainer
71 . . . housing side lock arm
72 . . . protrusion
73 . . . projection
74 . . . push-in portion
80 . . . coupling

What is claimed is:

1. A connector, comprising:

a first housing having opposite front and rear ends and an exterior facing outward on the first housing, a sealing surface defined on the exterior of the first housing and extending rearward from the front end;

a second housing including a receptacle, the first housing being fit into the receptacle;

a sealing ring disposed in the receptacle, the sealing ring having an inner surface that is held in close contact with the sealing surface on the exterior of the first housing when the first housing and the second housing are connected;

a protecting member mounted on the exterior of the first housing and covering the sealing surface before the first housing is fit in the receptacle; and a push-in portion disposed in the receptacle forward of the sealing ring, the push-in portion being configured to telescope over the front end of the first housing and to push the protecting member from the protecting position to the retracted position in the process of connecting the first housing and the second housing so that the sealing surface can move into close contact with the inner surface of the sealing ring.

2. The connector of claim 1, wherein:

the second housing includes a retainer inside the receptacle, the retainer restricting escape of the sealing ring, and the push-in portion is provided in the retainer.

3. The connector of claim 2, wherein:

the first housing includes a lock and a stopper, the second housing includes a housing side lock arm for restricting separation from the first housing by contact with the lock, the protecting member (50) includes a protecting member side lock arm for restricting a movement from the protecting position to the retracted position by contact with the stopper, and a coupling that links an operation of the housing side lock arm to ride over the lock and resiliently return and an operation of the protecting member side lock arm to ride over the stopper and resiliently return.

4. The connector of claim 3, wherein:

the protecting member side lock arm includes an operating portion on an end part, the operating portion releasing a contact stop state of the housing side lock arm and the lock by being pressed, and the operating portion is arranged to project from an opening of the receptacle when the first housing and the second housing (30) are connected.

5. The connector of claim 3, wherein the coupling is configured to achieve a convex-concave fitting of the housing side lock arm and the protecting member side lock arm in a connecting direction of the first housing and the second housing and restricts displacements of the housing side lock arm and the protecting member side lock arm in directions separating from each other.

6. The connector of claim 5, wherein:

the protecting member side lock arm includes an operating portion on an end part, the operating portion releasing a contact stop state of the housing side lock arm and the lock by being pressed, and the operating portion is arranged to project from an opening of the receptacle when the first housing and the second housing are connected.

7. A connector, comprising:

a first housing having a sealing surface, a lock and a stopper;

a second housing including a receptacle, the first housing being fit into the receptacle, the second housing further including a housing side lock arm for restricting separation from the first housing by contact with the lock;

a sealing ring disposed in the receptacle, the sealing ring being held in close contact with the sealing surface when the first housing and the second housing are connected a protecting member mounted on the first housing and covering the sealing surface, the protecting member being movable between a protecting position for covering the sealing surface and a retracted position retracted rearward from the sealing surface, the protecting member including a protecting member side lock arm for restricting a movement from the protecting position to the retracted position by contact with the stopper, and a coupling that links an operation of the housing side lock arm to ride over the lock and resiliently return and an operation of the protecting member side lock arm to ride over the stopper and resiliently return, wherein:

the second housing includes a push-in portion for pushing the protecting member from the protecting position to the retracted position in the process of connecting the first housing and the second housing.

8. The connector of claim 7, wherein the push-in portion is arranged inside the receptacle.

9. The connector of claim 8, wherein:

the second housing includes a retainer inside the receptacle, the retainer restricting escape of the sealing ring, and the push-in portion is provided in the retainer.

* * * * *